US009695794B2

(12) United States Patent
Yamoto et al.

(10) Patent No.: US 9,695,794 B2
(45) Date of Patent: Jul. 4, 2017

(54) CONTROL DEVICE OF PLASMA IGNITION APPARATUS AND PLASMA IGNITION APPARATUS

(71) Applicant: FUJITSU TEN LIMITED, Kobe-shi, Hyogo (JP)

(72) Inventors: Shoko Yamoto, Kobe (JP); Akio Okahara, Kobe (JP); Yusuke Masuda, Kobe (JP)

(73) Assignee: FUJITSU TEN LIMITED, Kobe (JP)

( * ) Notice: Subject to any disclaimer, the term of this patent is extended or adjusted under 35 U.S.C. 154(b) by 0 days.

(21) Appl. No.: 15/203,911

(22) Filed: Jul. 7, 2016

(65) Prior Publication Data

US 2017/0037827 A1 Feb. 9, 2017

(30) Foreign Application Priority Data

Aug. 7, 2015 (JP) ..... 2015-157078

(51) Int. Cl.

| | |
|---|---|
| ***F02P 23/04*** | (2006.01) |
| ***F02P 3/01*** | (2006.01) |
| ***H01T 13/02*** | (2006.01) |
| ***F02P 13/00*** | (2006.01) |
| ***H01T 13/04*** | (2006.01) |
| *F02P 9/00* | (2006.01) |
| *H01T 13/06* | (2006.01) |
| *H01T 13/40* | (2006.01) |
| *H01T 15/00* | (2006.01) |

(52) U.S. Cl.

CPC ..... *F02P 23/04* (2013.01); *F02P 3/01* (2013.01); *F02P 13/00* (2013.01); *H01T 13/02* (2013.01); *H01T 13/04* (2013.01); *F02P 9/007* (2013.01); *H01T 13/06* (2013.01); *H01T 13/40* (2013.01); *H01T 15/00* (2013.01)

(58) Field of Classification Search

CPC .... F02P 23/04; F02P 3/01; F02P 13/00; F02P 9/007; H01T 13/02; H01T 13/04; H01T 13/06; H01T 13/40; H01T 15/00

See application file for complete search history.

(56) References Cited

U.S. PATENT DOCUMENTS

| | | | | |
|---|---|---|---|---|
| 8,873,216 | B2 | 10/2014 | Ikeda et al. | |
| 8,887,683 | B2 * | 11/2014 | Smith | F02P 9/007 123/143 B |
| 2011/0114071 | A1 * | 5/2011 | Freen | F02P 17/12 123/623 |
| 2016/0281674 | A1 * | 9/2016 | Ikeda | H05H 1/46 |

FOREIGN PATENT DOCUMENTS

| | | | |
|---|---|---|---|
| JP | 2010-001827 | A | 1/2010 |
| WO | 2012/005201 | A1 | 1/2012 |

* cited by examiner

*Primary Examiner* — Don Le
(74) *Attorney, Agent, or Firm* — Oliff PLC

(57) ABSTRACT

A control device of a plasma ignition apparatus according to an embodiment includes a plug socket, an oscillation unit, and an amplification unit. The plug socket holds an ignition plug, and a high voltage generated by an ignition coil is transmitted to the ignition plug through the plug socket. The oscillation unit oscillates a high frequency. The amplification unit amplifies the high frequency oscillated by the oscillation unit. The oscillation unit is arranged outside of the plug socket and the amplification unit is arranged inside of the plug socket.

8 Claims, 6 Drawing Sheets

CONTROL DEVICE OF PLASMA IGNITION APPARATUS AND PLASMA IGNITION APPARATUS

CROSS-REFERENCE TO RELATED APPLICATION

This application is based upon and claims the benefit of priority of the prior Japanese Patent Application No. 2015-157078, filed on Aug. 7, 2015, the entire contents of which are incorporated herein by reference.

FIELD

The embodiment discussed herein is directed to a control device of a plasma ignition apparatus and the plasma ignition apparatus.

BACKGROUND

Conventionally, in an internal-combustion engine such as an automobile engine, a plasma ignition apparatus is proposed that supplies, for the expansion of a plasma region, a high frequency to a spark discharge as a core of the plasma to ignite an air-fuel mixture. Herein, the spark discharge is generated in a combustion chamber by using an ignition plug.

For example, Japanese Laid-open Patent Publication No. 2010-001827 discloses a plasma ignition apparatus that includes an ignition plug that generates a spark discharge, a microwave oscillator that generates a microwave, and an antenna that radiates the microwave generated by the microwave oscillator into a combustion chamber.

In the Japanese Laid-open Patent Publication No. 2010-001827, the microwave oscillator includes a generation unit that generates a microwave and an amplification unit that amplifies the microwave, and these units are integrally housed in a housing that blocks the microwave.

However, a technology described in the Japanese Laid-open Patent Publication No. 2010-001827 has room for improvement in saving space. This is because there is a possibility that installation of the microwave oscillator integrally including the generation and amplification units may be difficult in such a case that installation space is limited as in, for example, an engine room of an automobile.

SUMMARY

A control device of a plasma ignition apparatus according to an embodiment includes a plug socket, an oscillation unit, and an amplification unit. The plug socket holds an ignition plug, and a high voltage generated by an ignition coil is transmitted to the ignition plug through the plug socket. The oscillation unit oscillates a high frequency. The amplification unit amplifies the high frequency oscillated by the oscillation unit. The oscillation unit is arranged outside of the plug socket and the amplification unit is arranged inside of the plug socket.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENTS

Hereinafter, a control device of a plasma ignition apparatus and the plasma ignition apparatus according to a present embodiment will be described with reference to drawings. In the present embodiment, explanation is performed in an example that a plasma ignition apparatus is used in an engine for an automobile, however, the plasma ignition apparatus can be applied to other internal-combustion engines. Moreover, it is not intended that the present invention be limited to the embodiment described below.

Configuration of Plasma Ignition Apparatus

Figure 1:
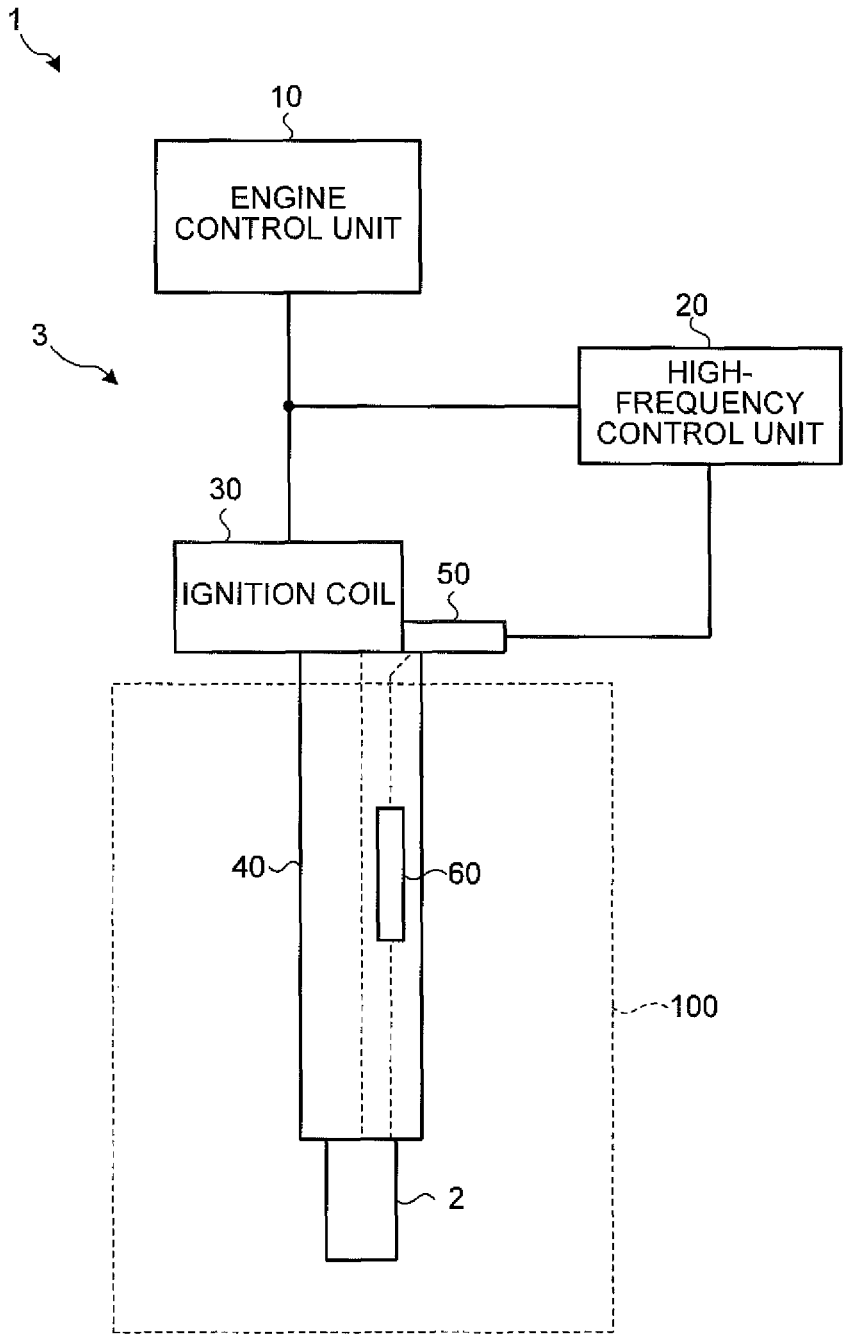
FIG. 1 is a diagram illustrating a configuration of a plasma ignition apparatus according to an embodiment.

FIG. 1 is a diagram illustrating a configuration of a plasma ignition apparatus 1 according to an embodiment. As illustrated in FIG. 1, the plasma ignition apparatus 1 includes an ignition plug 2 and a control device 3.

The ignition plug 2 is placed in a combustion chamber of an engine 100, and generates a spark discharge between a pair of electrodes (center electrode 26 and ground electrode 27 to be mentioned later) that are provided at the tip end of the ignition plug 2. The ignition plug 2 is also used as an antenna that radiates a high frequency into the combustion chamber.

The control device 3 controls supply of a high voltage and the high frequency to the ignition plug 2. The control device 3 includes an engine control unit 10, a high-frequency control unit 20, an ignition coil 30, a plug socket 40, an oscillation unit 50, and an amplification unit 60. The high voltage is used for generation of the spark discharge and the high frequency is used for generation of plasma.

The engine control unit 10 outputs an ignition signal to the ignition coil 30 at timing corresponding to a driving situation of the automobile or the like. The ignition signal controls a generation time of the spark discharge. The ignition signal is also input into the high-frequency control unit 20.

The high-frequency control unit 20 indicates to the oscillation unit 50 to oscillate the high frequency when the ignition signal is input.

The ignition coil 30 generates the high voltage in response to input from the engine control unit 10. Substantially, the ignition coil 30 includes a primary coil and a secondary coil, and generates the high voltage at the secondary coil by an induction phenomenon caused by cutting off the current that flows into the primary coil.

The plug socket 40 holds the ignition plug 2, and the plug socket 40 transmits the high voltage generated in the ignition coil 30 to the ignition plug 2.

The oscillation unit 50 oscillates the high frequency in accordance with indication of the high-frequency control unit 20. The amplification unit 60 amplifies the high frequency that is oscillated by the oscillation unit 50.

The ignition plug 2 generates the spark discharge in the combustion chamber by using the high voltage transmitted through the plug socket 40. The ignition plug 2 radiates the high frequency into the combustion chamber that is amplified by the amplification unit 60. Therefore, the high frequency is supplied to the spark discharge as a core of the plasma to enlarge a plasma region, and an air-fuel mixture in the combustion chamber is ignited.

Now, because a space in an engine room is limited in which the engine 100 is mounted, it is desirable that devices that are arranged outside of the engine 100 are miniaturized as much as possible.

Therefore, in the plasma ignition apparatus 1 according to the present embodiment, the oscillation unit 50 is arranged outside of the plug socket 40, and the amplification unit 60 is arranged inside of the plug socket 40.

By employing the configuration, devices that are arranged outside of the engine 100 can be miniaturized in size compared with the case of a conventional plasma ignition apparatus that includes a high frequency oscillation apparatus in which an oscillation unit and an amplification unit are combined. For this reason, employing the plasma ignition apparatus 1 according to the present embodiment can result in saving space and thus the size of mounted devices is not restricted.

Because upper temperature limits of the oscillation and amplification units usually differ, heat generation by one of the oscillation and amplification units may prevent the other unit from operating normally when the oscillation and amplification units are integrated. Substantially, because the upper temperature limit of the oscillation unit is often lower than that of the amplification unit, heat generation by the amplification unit may prevent the oscillation unit from operating normally.

On the contrary, in the plasma ignition apparatus 1 according to the present embodiment, because the oscillation unit 50 and the amplification unit 60 are arranged at separate positions, influence of the heat generation by one of the oscillation unit 50 and the amplification unit 60 to the other unit can be reduced. For this reason, by employing the plasma ignition apparatus 1 according to the present embodiment, the oscillation unit 50 and the amplification unit 60 can normally operate and thus the high frequency can be stably supplied to the ignition plug 2.

Configuration of Control Device

Figure 2:
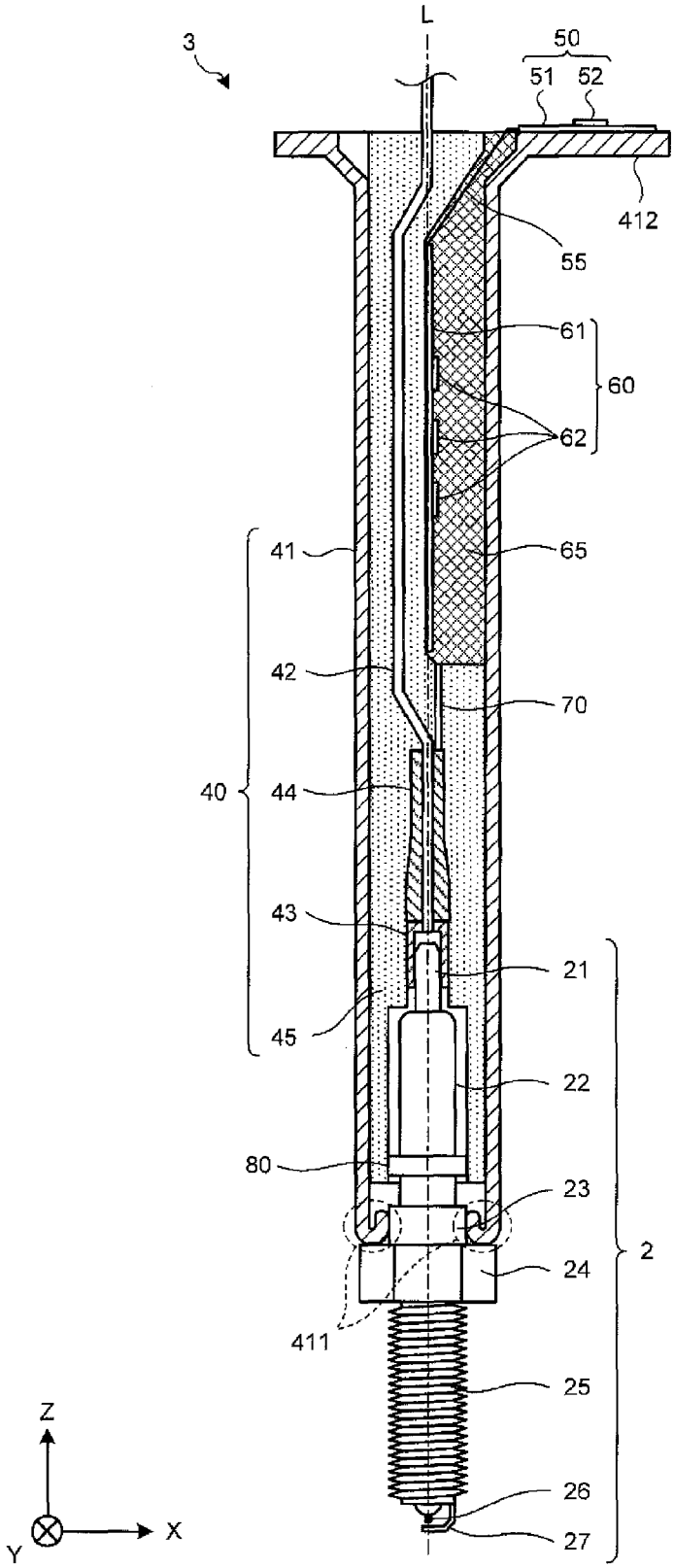
FIG. 2 is a diagram illustrating a configuration of a control device.
Figure 3:
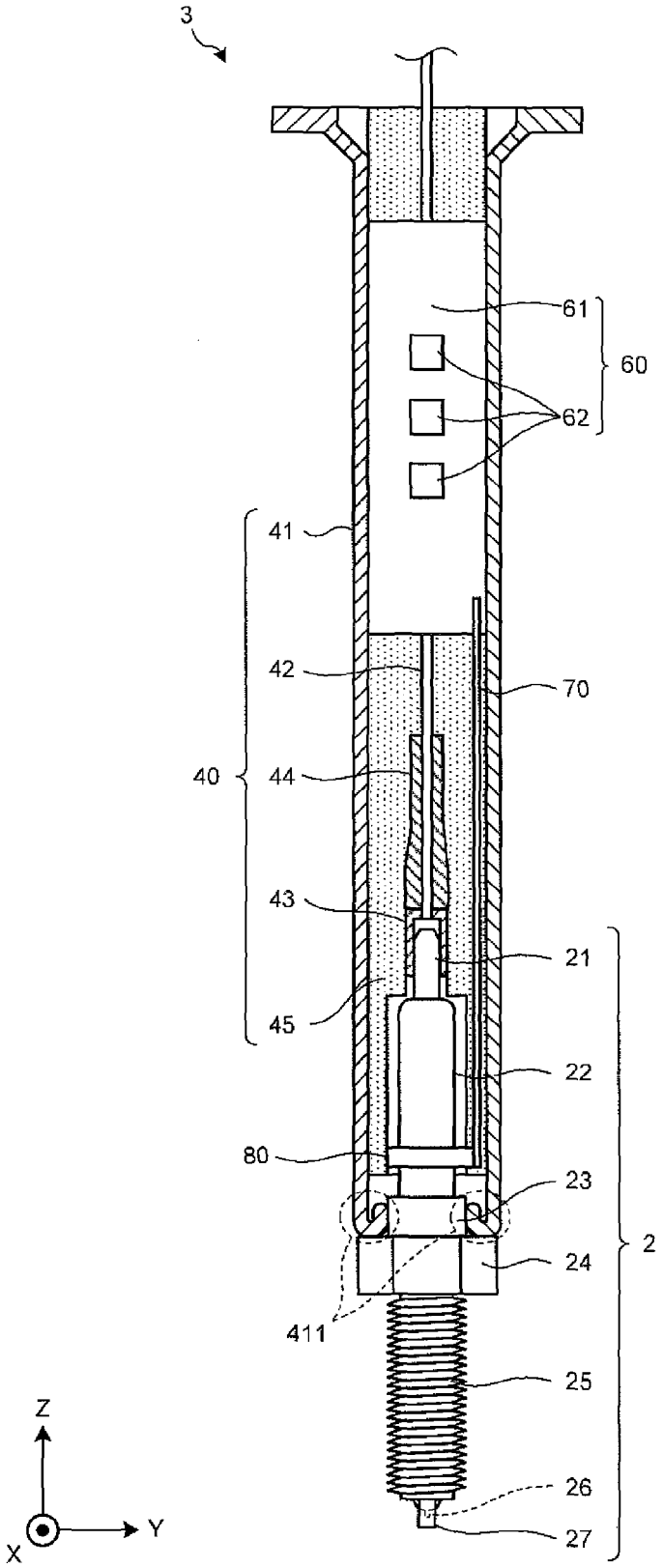
FIG. 3 is a diagram illustrating the configuration of the control device.

Hereinafter, a configuration of the control device 3 of the plasma ignition apparatus 1 according to the present embodiment will be explained specifically. FIGS. 2 and 3 are diagrams illustrating the configuration of the control device 3.

In FIGS. 2 and 3, three axes that are perpendicular to each other are denoted as the X-axis, the Y-axis, and the Z-axis to clarify positional relationship. FIG. 2 is a diagram illustrating the control device 3 when viewed from the negative direction of the Y-axis. FIG. 3 is a diagram illustrating the control device 3 when viewed from the positive direction of the X-axis. In FIGS. 2 and 3, a part of the control device 3 is illustrated by cross-sectional views.

As illustrated in FIGS. 2 and 3, the ignition plug 2 includes a center conductor 21, an insulator 22, a contact part 23, a nut 24, a screw 25, a center electrode 26, and a ground electrode 27 in this order from a base end (positive side of Z-axis) thereof.

The center conductor 21 transmits the high voltage that is supplied from the ignition coil 30 (see FIG. 1) to the center electrode 26 through the plug socket 40. The insulator 22 is an insulating member that covers the center conductor 21. The contact part 23 is a cylindrical metal member whose diameter is larger than that of the insulator 22 and is smaller than that of a socket body 41 of the plug socket 40 that will be mentioned later. The contact part 23 is provided on an edge surface of the nut 24 to protrude from the edge surface, in which the edge surface is located closer to the plug socket 40 (positive side of Z-axis). The contact part 23 will be described later with reference to FIG. 4.

The nut 24 and the screw 25 are fastening parts that are used to attach the ignition plug 2 to the engine 100. The nut 24 is a metal member whose diameter is larger than that of the socket body 41 and is, for example, a hexagonal nut. The center electrode 26 and the ground electrode 27 are arranged opposite to each other. The high voltage from the ignition coil 30 is applied to the center electrode 26, and the ground electrode 27 is ground to the engine 100.

The plug socket 40 includes the socket body 41, an internal conductor 42, a terminal 43, a high-frequency attenuation unit 44, and a sealing member 45.

The socket body 41 is a cylindrical member with its ends opening, and includes a holding part 411 at its tip end and a flange 412 at the other end. The holding part 411 holds the ignition plug 2, and the flange 412 is provided with the oscillation unit 50. The flange 412 is protruded from the socket body 41 toward the outside along an orthogonal direction to an axis line L of the socket body 41. The socket body 41 also functions as an outer conductor that grounds the ground electrode 27 of the ignition plug 2 to the engine 100.

The internal conductor 42 is arranged inside of the socket body 41 and the high voltage generated by the ignition coil 30 is transmitted to the ignition plug 2 through the internal conductor 42 and the terminal 43.

The intermediate part of the internal conductor 42 is arranged to be displaced from the axis line L of the socket body 41. Therefore, the amplification unit 60 can be arranged in substantially the middle part (vicinity of axis line L) of the cross section of the plug socket 40 along the orthogonal direction to the axis line L.

The terminal 43 is an electrical connection part between the ignition plug 2 and the center conductor 21. The high-frequency attenuation unit 44 is arranged on the outer periphery of the internal conductor 42 and attenuates the high frequency that flows into the internal conductor 42 from the ignition plug 2. Therefore, the high frequency that is input to the ignition plug 2 from an antenna 80 to be mentioned later can be prevented from flowing back to the ignition coil 30 or the like through the internal conductor 42. The sealing member 45 is made of, for example, resin to seal the internal conductor 42, the terminal 43, the high-frequency attenuation unit 44, or the like inside the plug socket 40 and fix them.

The oscillation unit 50 includes a substrate 51 and an oscillation element 52 mounted on the substrate 51. The oscillation unit 50 is arranged outside of the plug socket 40. Substantially, the oscillation unit 50 is arranged on the flange 412 of the plug socket 40. The high frequency that is oscillated by the oscillation unit 50 is output to the amplification unit 60 through a transmission path 55.

The amplification unit 60 includes a substrate 61 and amplification elements 62 that are mounted on the substrate 61. The amplification unit 60 is arranged in substantially the middle part of the cross section of the socket body 41 along the orthogonal direction to the axis line L. Therefore, heat from the amplification unit 60 cannot be easily conducted to the outside of the plug socket 40. Moreover, a sufficient space for providing the amplification unit 60 can be secured.

The transmission path 55 and the amplification unit 60 are sealed and fixed by the seal part 65 made of such as resin.

The amplification unit 60 is preferably arranged in the position not to overlap with the high-frequency attenuation unit 44, substantially, the position that is closer (positive side of Z-axis) to the ignition coil 30 (see FIG. 1) than the high-frequency attenuation unit 44 in consideration of the influence to the high-frequency attenuation unit 44.

In this way, by employing the control device 3 according to the present embodiment, the amplification unit 60, among the oscillation unit 50 and the amplification unit 60, is arranged inside of the socket body 41, and thus devices that are arranged outside of the engine 100 can be miniaturized in size. Moreover, influence to the oscillation unit 50 of the heat generation by the amplification unit 60 can be reduced.

The control device 3 further includes a high-frequency transmission path 70 and the antenna 80. The high frequency that is amplified by the amplification unit 60 is transmitted to the antenna 80 through the high-frequency transmission path 70. The antenna 80 outputs the high frequency to the ignition plug 2 that has been transmitted through the high-frequency transmission path 70 from the amplification unit 60.

The antenna 80 is a loop antenna, and is provided at the position at which the antenna 80 is fitted to the outer periphery part of the insulator 22 included in the ignition plug 2 when the ignition plug 2 is hold by the plug socket 40. The high frequency that is output from the antenna 80 is supplied to the nut 24 and the screw 25 of the ignition plug 2 through the insulator 22, and is radiated into the combustion chamber while using the nut 24 and the screw 25 as an antenna.

In the control device 3 according to the present embodiment, not only the amplification unit 60 but also the high-frequency transmission path 70 and the antenna 80 are arranged inside of the socket body 41. Therefore, the space can be further saved.

Moreover, in the control device 3 according to the present embodiment, the distance from the amplification unit 60 to the ignition plug 2 can be shortened compared with the case in which the amplification unit 60 is arranged outside of the plug socket 40 by arranging the amplification unit 60 inside of the plug socket 40. In other words, the length of the high-frequency transmission path 70 can be shortened, and thus power loss on the high-frequency transmission path 70 can be reduced. Therefore, output power of the amplification unit 60 by this amount can be reduced. For this reason, the heat generation by the amplification unit 60 can be restrained.

Configuration of Holding Part of Socket Body

Figure 4:
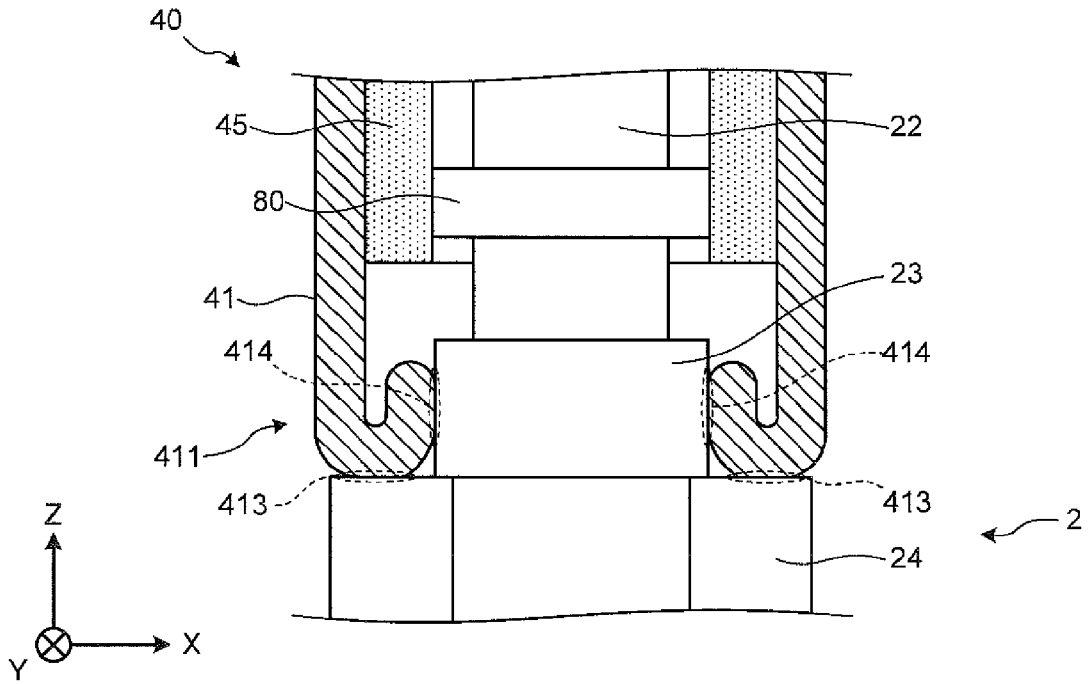
FIG. 4 is a diagram illustrating a configuration of a holding part of a socket body.

Next, a configuration of the holding part 411 of the socket body 41 will be explained with reference to FIG. 4. FIG. 4 is a diagram illustrating the configuration of the holding part 411 of the socket body 41.

As illustrated in FIG. 4, the holding part 411 is a bend part in which, for example, the tip end of the socket body 41 is bent into the inner peripheral side at approximately 180 degrees, and forms an opening whose diameter is smaller than that of the socket body 41. The ignition plug 2 is inserted through the opening into the socket body 41, the edge surface of the nut 24 closer to the socket body 41 abuts on the tip end surface (first contact surface 413) of the holding part 411, and the ignition plug 2 is hold by the socket body 41 in such a state that the outer peripheral surface of the contact part 23 is in contact with the inner peripheral surface (second contact surface 414) of the holding part 411.

In this way, in the plasma ignition apparatus 1 according to the present embodiment, the contact part 23 is provided in the ignition plug 2 and the holding part 411 is provided in the socket body 41, in which the holding part 411 includes the first contact surface 413 that contacts the edge surface of the nut 24 closer to the plug socket 40 and the second contact surface 414 that contacts the outer peripheral surface of the contact part 23.

Therefore, because the socket body 41 and the ignition plug 2 contact with each other by a large area, electrical connection between the socket body 41 that is the outer conductor and the ground electrode 27 of the ignition plug 2 can be stabilized. Moreover, because a gap between the socket body 41 and the ignition plug 2 is hardly generated, plasma can be generated appropriately by preventing, for example, leakage of the high frequency that is output from the antenna 80.

As described above, the control device 3 of the plasma ignition apparatus 1 according to the present embodiment includes the plug socket 40, the oscillation unit 50, and the amplification unit 60. The plug socket 40 holds the ignition plug 2, and transmits the high voltage that is generated by the ignition coil 30 to the ignition plug 2. The oscillation unit 50 oscillates the high frequency. The amplification unit 60 amplifies the high frequency that is oscillated by the oscillation unit 50. The oscillation unit 50 is arranged outside of the plug socket 40 and the amplification unit 60 is arranged inside of the plug socket 40.

For this reason, by employing the control device 3 according to the present embodiment, because devices that are arranged outside of the engine 100 is miniaturized in size, the space can be saved. Moreover, by employing the control device 3 according to the present embodiment, because the oscillation unit 50 and the amplification unit 60 are arranged at separate positions, the influence of the heat generation by the amplification unit 60 to the oscillation unit 50 can be reduced.

First Modified Example

In the aforementioned embodiment, an example in such a case that the amplification unit 60 is arranged in substantially the middle part of the cross section of the socket body 41 along the orthogonal direction to the axis line L has been explained, however, arrangement of the amplification unit 60 is not limited thereto. Therefore, modified examples in which the amplification unit 60 is arranged will be explained hereinafter. In the following description, elements identical with those having already explained are denoted by identical reference symbols, and duplicate description will be omitted.

Figure 5:
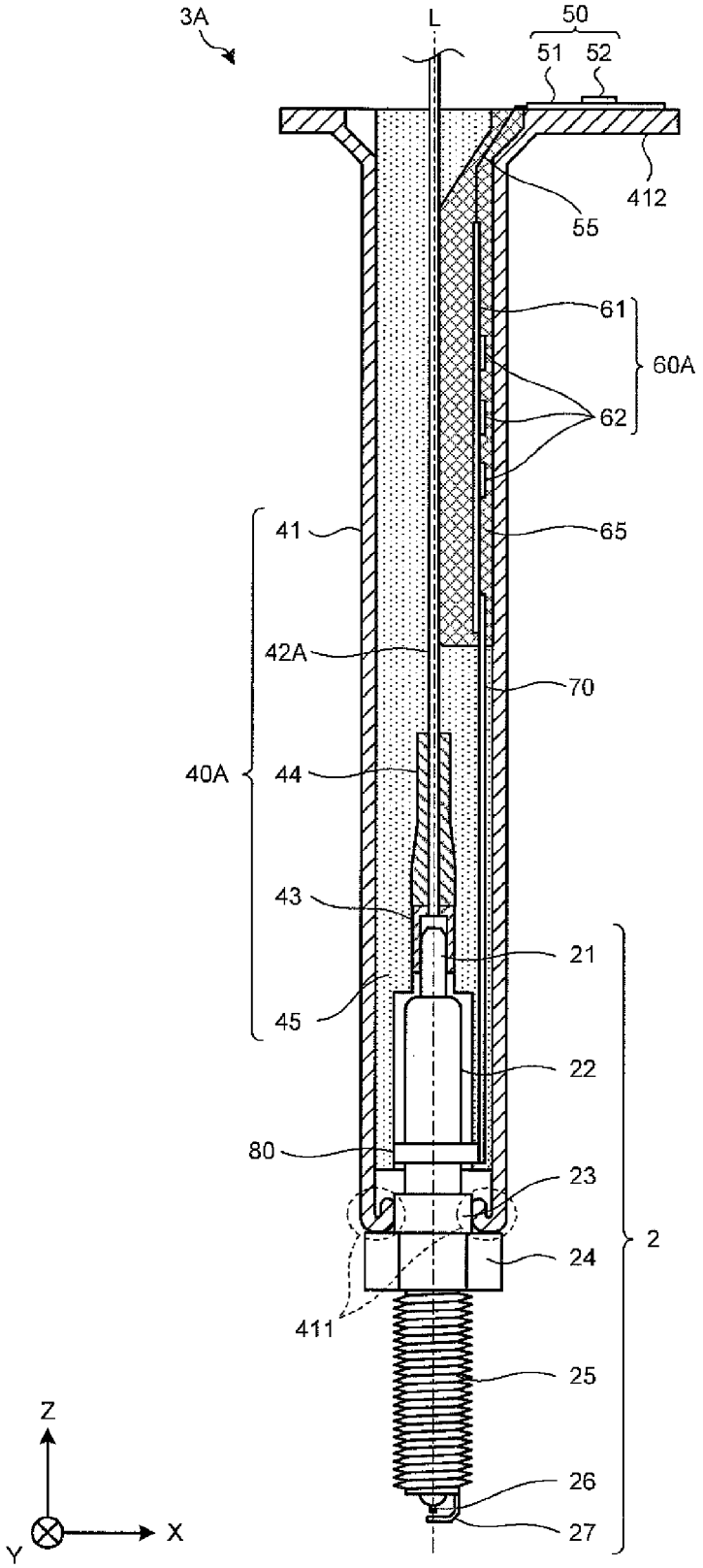
FIG. 5 is a schematic cross-sectional view illustrating a control device according to a first modified example.

FIG. 5 is a schematic cross-sectional view illustrating a control device 3A according to the first modified example. As illustrated in FIG. 5, an amplification unit 60A may be arranged in the position that is closer to the periphery part than the middle part of the cross section of the inside of the socket body 41 along the orthogonal direction to the axis line L. When the arrangement is selected, because an internal conductor 42A of a plug socket 40A can be arranged along the axis line L of the socket body 41, assembly of the plug socket 40A can be facilitated.

Second Modified Example

Figure 6:
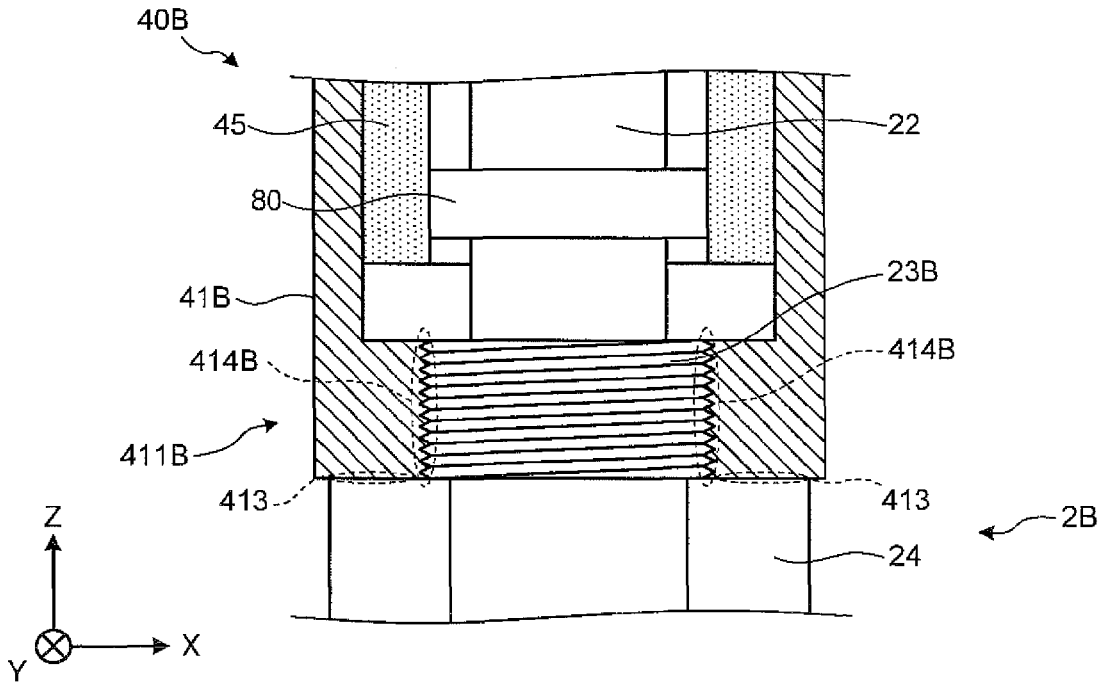
FIG. 6 is a diagram illustrating a configuration of a holding part of a socket body according to a second modified example.

Next, a modified example of the holding part 411 that is included in the socket body 41 will be explained with reference to FIG. 6. FIG. 6 is a diagram illustrating a configuration of a holding part 411B of a socket body 41B according to the second modified example.

As illustrated in FIG. 6, an ignition plug 2B according to the second modified example includes a contact part 232. A plug socket 40B according to the second modified example includes the socket body 41B. The screw thread and the screw groove that screw with each other are formed respectively on the outer peripheral surface of the contact part 23B and a second contact surface 414B of the holding part 411B included in the socket body 41B.

In this way, electrical connection between the socket body 41B and the ignition plug 2B can be further stabilized by screwing the holding part 411B of the socket body 41B and the contact part 23B of the ignition plug 2B together. Moreover, for example, leakage of the high frequency that is output from the antenna can be prevented more surely.

As described above, according to an aspect of the embodiment, the space can be saved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A control device of a plasma ignition apparatus, the control device comprising:

a plug socket that holds an ignition plug and through which a high voltage generated by an ignition coil is transmitted to the ignition plug;

an oscillation unit that oscillates a high frequency; and an amplification unit that amplifies the high frequency oscillated by the oscillation unit, wherein the oscillation unit is arranged outside of the plug socket and the amplification unit is arranged inside of the plug socket.

2. The control device of the plasma ignition apparatus according to claim 1, the control device further comprising:

a high-frequency transmission path through which the high frequency amplified by the amplification unit is transmitted; and an antenna that is connected to the high-frequency transmission path, the antenna outputting the high frequency, wherein the antenna and the high-frequency transmission path are arranged inside of the plug socket.

3. The control device of the plasma ignition apparatus according to claim 2, wherein the antenna includes a loop antenna, and the antenna is provided at a position at which the antenna is fitted to an outer periphery part of an insulator included in the ignition plug when the ignition plug is hold by the plug socket.

4. The control device of the plasma ignition apparatus according to claim 1, wherein the plug socket includes:

an internal conductor that is arranged inside of the plug socket and through which the high voltage generated by the ignition coil is transmitted to the ignition plug; and a high-frequency attenuation unit that is provided on the internal conductor, the high-frequency attenuation unit attenuating the high frequency that flows back to the internal conductor from the ignition plug.

5. The control device of the plasma ignition apparatus according to claim 1, wherein the plug socket includes a cylindrical socket body, and the amplification unit is arranged in substantially a middle part of a cross section of the socket body along an orthogonal direction to an axis line of the socket body.

6. The control device of the plasma ignition apparatus according to claim 5, wherein the socket body includes a flange at one end that is opposite to another end at which the ignition plug is hold, and the oscillation unit is arranged on the flange.

7. A plasma ignition apparatus comprising:

an ignition coil that generates a high voltage;

an ignition plug that generates a spark discharge by using the high voltage generated by the ignition coil;

a plug socket that holds the ignition plug and through which the high voltage generated by the ignition coil is transmitted to the ignition plug;

an oscillation unit that oscillates a high frequency; and an amplification unit that amplifies the high frequency oscillated by the oscillation unit, wherein the oscillation unit is arranged outside of the plug socket and the amplification unit is arranged inside of the plug socket.

8. The plasma ignition apparatus according to claim 7, wherein the plug socket includes a cylindrical socket body, the ignition plug includes:

a nut whose diameter is larger than that of the socket body; and a contact part that is provided on an edge surface of the nut to protrude from the edge surface and whose diameter is smaller than that of the socket body, and the socket body includes:

a first contact surface that is in contact with the edge surface of the nut; and a second contact surface that is in contact with an outer peripheral surface of the contact part.

* * * * *